US008814071B2

(12) United States Patent
Jeker et al.

(10) Patent No.: US 8,814,071 B2
(45) Date of Patent: Aug. 26, 2014

(54) AGITATOR BALL MILL

(75) Inventors: Erich Jeker, Busserach (CH); Frank Ronald Lang, Muttenz (CH); Marc Weider, Blotzheim (FR)

(73) Assignee: Willy A. Bachofen AG, Muttenz (CH)

( * ) Notice: Subject to any disclaimer, the term of this patent is extended or adjusted under 35 U.S.C. 154(b) by 331 days.

(21) Appl. No.: 13/203,085

(22) PCT Filed: Feb. 24, 2010

(86) PCT No.: PCT/EP2010/052337

§ 371 (c)(1),
(2), (4) Date: Aug. 24, 2011

(87) PCT Pub. No.: WO2010/112274

PCT Pub. Date: Oct. 7, 2010

(65) Prior Publication Data

US 2011/0303774 A1 Dec. 15, 2011

(30) Foreign Application Priority Data

Feb. 24, 2009 (CH) ..... 0273/09

(51) Int. Cl.
*B02C 17/14* (2006.01)
*B02C 17/16* (2006.01)

(52) U.S. Cl.
USPC ..... 241/21; 241/171; 241/172

(58) Field of Classification Search
USPC ..... 241/21, 171, 172
See application file for complete search history.

(56) References Cited

U.S. PATENT DOCUMENTS

| | | | | |
|---|---|---|---|---|
| 5,566,896 | A * | 10/1996 | Stehr et al. | 241/171 |
| 5,597,126 | A * | 1/1997 | Frommherz et al. | 241/172 |
| 5,620,147 | A * | 4/1997 | Newton | 241/171 |
| 5,984,213 | A | 11/1999 | Woodall et al. | |
| 7,014,134 | B2 * | 3/2006 | Heinzelmann et al. | 241/171 |
| 8,118,247 | B2 * | 2/2012 | Lang et al. | 241/171 |
| 2005/0258288 | A1 * | 11/2005 | Dalziel et al. | 241/172 |
| 2009/0212141 | A1 * | 8/2009 | Taylor | 241/22 |
| 2011/0036935 | A1 * | 2/2011 | Stehr | 241/69 |

FOREIGN PATENT DOCUMENTS

| | | | |
|---|---|---|---|
| DE | 40 09 092 | C1 | 5/1991 |
| DE | 4412408 | A1 | 10/1995 |
| EP | 0146852 | A1 | 7/1985 |
| EP | 0627262 | A1 | 12/1994 |

OTHER PUBLICATIONS

International Search Report: mailed Jul. 27, 2010; PCT/EP2010/052337.

* cited by examiner

*Primary Examiner* — Faye Francis
(74) *Attorney, Agent, or Firm* — Ladas & Parry LLP

(57) ABSTRACT

An agitator ball mill having a milling chamber and an agitator having a rotatably mounted and driven agitator shaft and accelerators arranged thereupon, wherein the accelerator that is arranged furthest downstream, that is, the accelerator closest to the milling material outlet, lengthens axially and extends along the axial length of the sieve.

11 Claims, 2 Drawing Sheets

AGITATOR BALL MILL

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

FIELD OF THE INVENTION

The invention relates to an agitator ball mill having a milling chamber which is bounded by a side wall and in each case one front wall on the inlet side and one front wall on the outlet side, an agitator which is arranged in the milling chamber and has a rotatably mounted and driven agitator shaft and accelerators arranged thereon, an inlet for milling material and milling media arranged close to the front wall on the inlet side, a milling material outlet which is arranged in the front wall on the outlet side and is separated from the milling chamber by a sieve. The invention also relates to a method for preventing clogging of a sieve arranged upstream of the milling material outlet of the agitator ball mill, characterized in that the mass flow of milling material and milling media flowing from the milling material inlet to the milling material outlet is deflected in the region of the sieve and is guided along the outer surface of the sieve in the direction opposite to the flow direction.

BACKGROUND OF THE INVENTION

In case of known agitator ball mills of this type there is the serious problem which is still not solved satisfactorily that the sieve arranged upstream of the milling material outlet often clogs in an increasing manner after a short operating time and thus decreases the throughput until finally an interruption of the operation is necessary in order to clean the sieve.

In order to solve this problem, various constructional solutions involving separators arranged upstream of the sieve have been proposed. One of the most recent developments in this direction is described e.g. in EP-751830. This development provides to arrange, in addition to a separator arranged upstream of the sieve and upstream of said separator, an upstream device for pre-screening between coarse and fine particles. This device substantially provides to make the distance between the last disk of the agitator and the separator small enough that the mixture of milling material and milling media in this intermediate space is stronger accelerated than in the remaining milling chamber and thereby, the separation, which is called "pre-screening", takes place. In this manner it is to be achieved that less or no coarse milling media reach the sieve.

However, it is most likely that in a continuous operation, even with this solution, clogging of the sieve can take place. It is therefore the object of the invention to prevent clogging of the sieve in a different and more effective manner.

BRIEF SUMMARY OF THE INVENTION

To prevent clogging of the sieve, in this invention the accelerator arranged furthest downstream, i.e. the accelerator closest to the milling material outlet, is axially lengthened and extends downstream along the axial length of the sieve. In this manner, according to the invention, the mass flow of milling material and milling media flowing from the milling material inlet to the milling material outlet is deflected in the region of the sieve and is guided along the outer surface of the sieve in the direction opposite to the flow direction.

Preferably, the accelerators are formed as blade wheels. Furthermore, the blades of the blade wheel arranged furthest downstream extend over the entire axial length of the sieve, in any case at least over more than half of the length of the same.

According to a preferred embodiment of the invention, a deflection channel annularly surrounding the sieve is arranged in the front wall of the outlet side. For reducing dead spaces, the deflection channel preferably has a shape similar to a toroid halved perpendicular to its axis.

According to a particular embodiment of the invention, the sieve is conically widened in the direction toward the front wall on the outlet side.

BRIEF DESCRIPTION OF THE DRAWINGS

Further preferred embodiments of the invention are described by means of the enclosed drawings. In the figures.

DETAILED DESCRIPTIN OF THE INVENTION

For the present description, the terms upstream and downstream with respect to the direction of the milling material flows through the mill, i.e. from the milling material inlet downstream to the milling material outlet, are also used for design features. The milling material flow is indicated with the black arrows.

Figure 1:
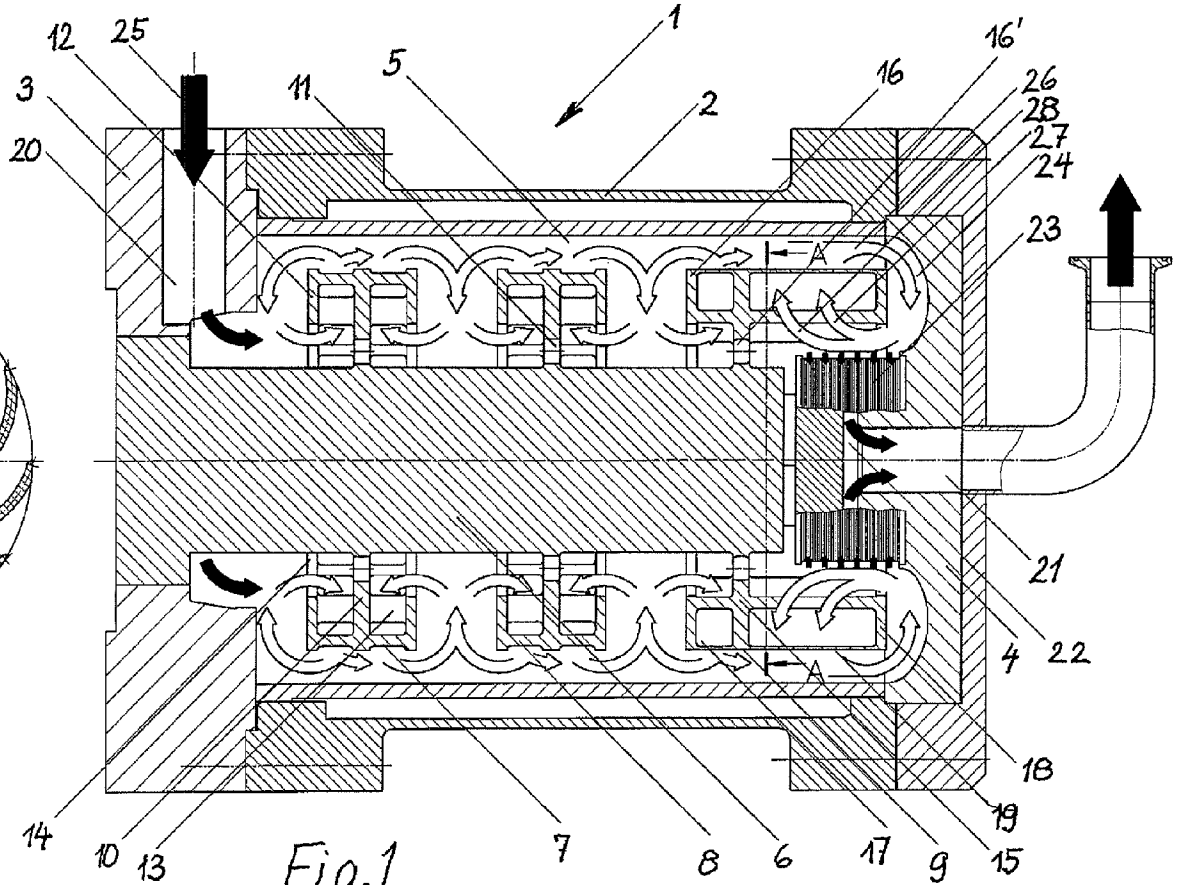
FIG. 1 shows an agitator ball mill according to the invention in a sectional view through an axial plane

The agitator ball mill 1 shown in FIG. 1 in an axial section has a housing comprising a cylindrical side wall 2, a plane front wall 3 on the inlet side and a plane front wall 4 on the outlet side. The side wall and the front walls define a milling chamber 5. In the milling chamber, an agitator is arranged coaxially to the housing axis, which agitator consists of an agitator shaft 6 rotatably mounted in the front wall on the inlet side and three accelerators in the form of blade wheels 7, 8, 9 arranged equidistantly on said agitator shaft.

The blade wheel 7 on the inlet side and the central blade wheel 8 are identical and consist of a central disk 10 which is fixedly connected to the agitator shaft 6 and has axially parallel bores 11 located close to the agitator shaft, and annular disks 12 arranged on both sides of said central disk, wherein a number of vanes 13 arranged in equal angular distances extends between these disks. The outer disks 12 have an opening 14 which extends annularly around the agitator shaft 6.

Alternatively, the blade wheels can also be structured differently, thus can consist, for example, of two parallel disks and blades arranged therebetween. Also, the bores 11 can extend at an angle to the axis. In this manner, compressing the milling media is counteracted. The bores can also be formed in a slot-shaped manner.

Figure 2:
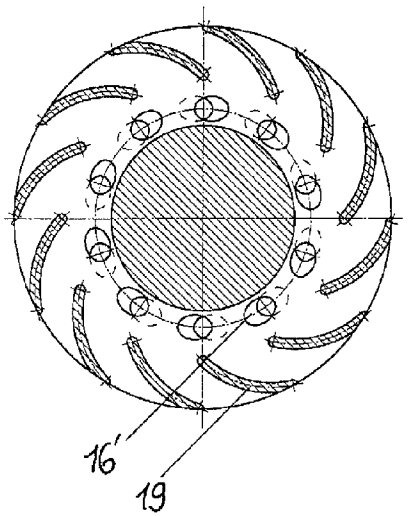
FIG. 2 shows a section perpendicular to the plane A-A of the agitator ball mill according to FIG. 1

The blade wheel 9 on the outlet side or, respectively, the blade wheel arranged furthest downstream, also has a central disk 15 which is fixedly connected to the agitator shaft 6 and has bores 16' which are axially parallel or extend at an angle to the axis and which is arranged close to the agitator shaft's end on the outlet side. Toward the milling chamber, as with the other blade wheels, an annular disk 16 is arranged at a distance and is connected to the central disk 15 by a number of vanes 17. On the other side of the central disk 15 there is also an annular disk 18; however, at a larger distance from the central disk located close to the front wall on the outlet side. This larger distance extending at an angle to the axis is at least twice as large as the distances of the lateral annular disks from the respective central disks. Between these two disks too, a number of vanes 19 extend. The shape of the vanes is shown in FIG. 2 which illustrates a section along the line A-A in FIG. 1. The vanes are helically shaped with respect to the agitator shaft, i.e. curved and angularly offset with respect to the radial direction.

In the front wall 3 on the inlet side, an inlet channel 20 is arranged which opens out near the agitator shaft 6 into the milling chamber. In the center of the front wall 4 on the outlet side, an outlet channel 21 is arranged coaxially to the agitator shaft, which outlet channel is connected via an annular gap 22 to the milling chamber, wherein between the milling chamber and the entrance to the gap, a sieve 23 is arranged which prevents the passage of milling media and coarse milling material particles to the outlet.

Moreover, the front wall on the outlet side is provided with a sieve surrounding the deflection channel 24. Said deflection channel has an arc-shaped cross-section and, for example, exists in the form of an approximately toroid-like annular indentation in the front wall. The lowest region of the deflection channel is located approximately opposite to the center of the vanes 19. The radially outer edge of the deflection channel corresponds to the outer circumference of the milling chamber so that a streamlined transition is created. Due to the shape and the arrangement of the deflection channel, dead spaces are avoided and the milling material-milling media flow is optimized.

Also, between the accelerators, disks can be arranged on the agitator shaft, which disks prevent a flow of poorly milled milling material along the agitator shaft.

As already mentioned, apart from the structural parts of the agitator ball mill, FIG. 1 also shows the mass flows. The black arrows 25 indicate the product mass flow, i.e. the milling material without milling media, while the outlined arrows 26 illustrate the circuits of the mixture of milling material and milling media taking place in the milling chamber. Accordingly, in the region of the blade wheels acting as milling members, the known circuits take place in which the milling material is comminuted through the action of the milling media.

As shown, in the region of the blade wheel 9 arranged furthest downstream, i.e. the blade wheel on the outlet side, likewise, a circuit takes place in which the milling material-milling media mixture flows between the blade wheel and the side wall substantially in the axial direction to the front wall on the outlet side and there around the blades and between the sieve 23 and the blade wheel back in the opposite axial direction. This oppositely directed flow accelerates a portion dedicated by the arrow 27 via the blades to the outside, whereas the other portion dedicated by the arrow 28 initially runs along the sieve and prevents material from accumulating on the outer surface of the sieve, which material would otherwise clog up the sieve. Further upstream, said portion 28 is thrown outwardly, again by the vanes.

At the same time, milling of insufficiently comminuted milling particles is carried out also in the region of the blade wheel 9 arranged furthest downstream through the contact with the milling media, which contact takes place also in this region.

Due to the formation of the deflection channel, dead spaces within the flow are avoided so that the kinetic energy which is transferred from the blade wheel to the milling media is conserved during the recirculation of the milling media into the circuit. Thus, the entire milling chamber is utilized for comminuting and dispersing the milling material.

Figure 3:
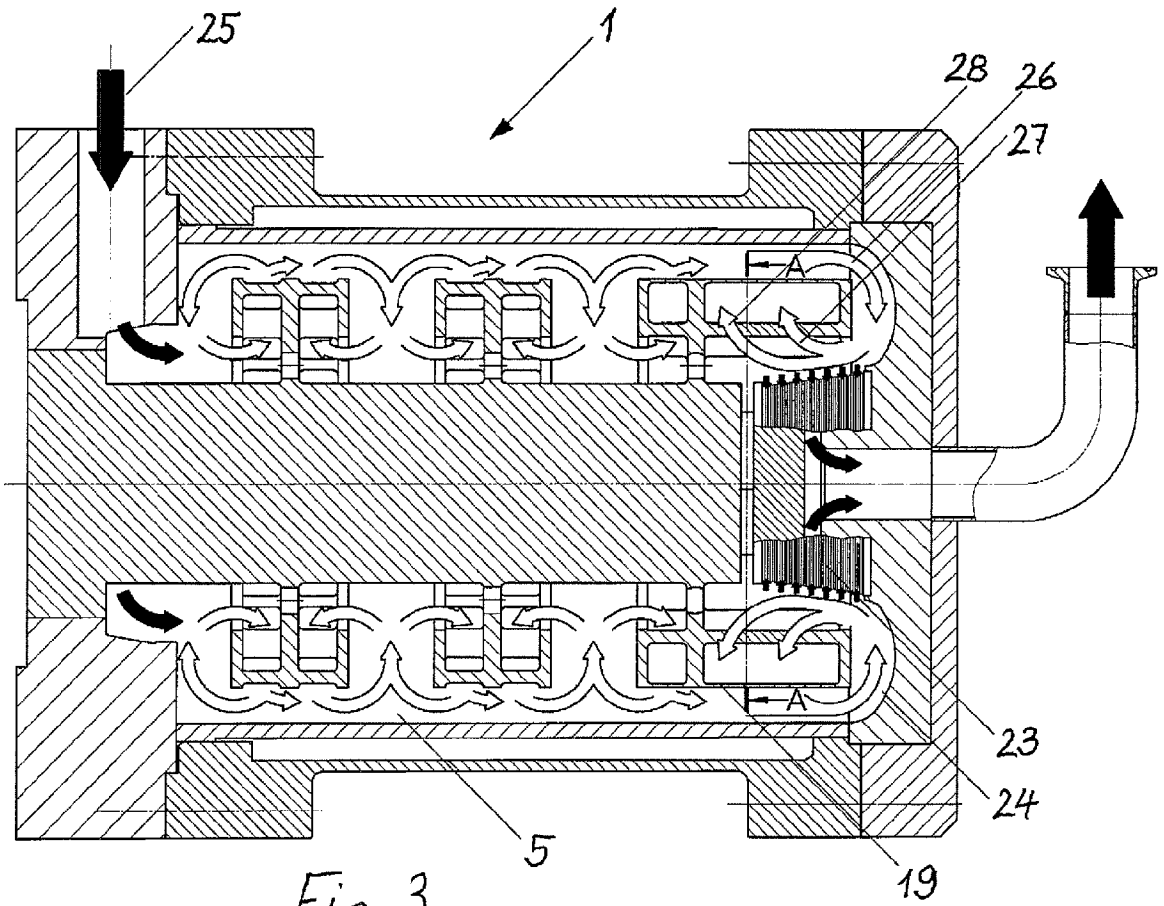
FIG. 3 shows an alternative embodiment of an agitator ball mill according to the invention
Figure 4:
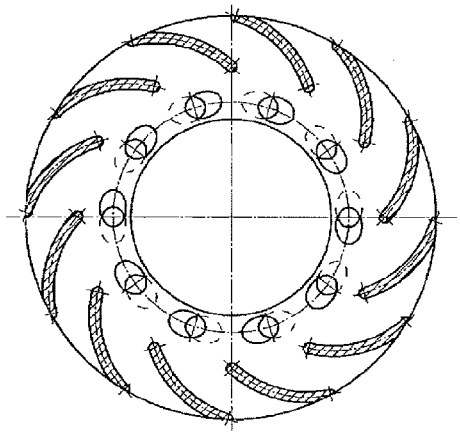
FIG. 4 shows a section perpendicular to the axis in the plane A-A of the agitator ball mill according to FIG. 3

The embodiment shown in FIG. 3 is structured in substantially the same way as the already described agitator ball mill 1 but with the difference that the sieve 23 is formed conically and tapers toward the milling chamber. With this shape it is achieved that the flow effecting the cleaning of the sieve can be guided in a more defined manner.

While in case of the shown and described exemplary embodiments a total of only three blade wheels is arranged on the agitator shaft, it is of course also possible that other embodiments have more blade wheels. Also, the shape of the deflection channel can be configured differently as long as the deflection of the mixture flow takes place. The number of vanes with which the blade wheels are equipped can vary within wide limits and is preferably between five and twenty.

The invention claimed is:

1. An agitator ball mill comprising:

a milling chamber which is bounded by a side wall, a front wall on an inlet side and a front wall on an outlet side, wherein in the front wall on the outlet side a deflection channel arranged which annularly surrounds a sieve, an agitator arranged in the milling chamber having a rotatably mounted and driven agitator shaft and a plurality of accelerators arranged thereon from the inlet side to the outlet side, an inlet for milling material and milling media arranged close to the front wall on the inlet side, an outlet for milling material arranged in the front wall on the outlet side, wherein the outlet is separated from the milling chamber by the sieve located between the chamber and the outlet, wherein the accelerator arranged closest to the outlet comprises blades which are axially lengthened and extend along the axial length of the sieve, and wherein the deflection channel is arranged in proximity to the accelerator closest to the outlet and the sieve in a configuration to in use allow milling material and media to flow between the sieve and the blades and along a surface of the sieve thereby preventing material accumulation on the sieve.

2. The agitator ball mill according to claim 1, wherein the accelerator arranged closest to the outlet comprises a number of vanes which are formed spirally with respect to the agitator shaft axis.

3. The agitator ball mill according to claim 1, wherein each accelerator has a central disk fixedly connected to the agitator shaft and annular discs arranged on both of the central disk, wherein the central disk has axially parallel bores located close to the agitator shaft, and wherein between the central disk and the annular discs on both sides of the central disk a plurality of vanes are arranged equidistant therebetween.

4. The agitator ball mill according to claim 3, wherein the disks are provided with bores which are angularly offset with respect to the axis.

5. The agitator ball mill according to claim 1, wherein the accelerator arranged closest to the outlet extends at least over half of the axial length of the sieve.

6. The agitator ball mill according to claim 1, wherein the accelerator arranged closest outlet extends over the entire axial length of the sieve.

7. The agitator ball mill according to claim 1, wherein the deflection channel is an arc-shaped cross-section.

8. The agitator ball mill according to claim 1, wherein the radially outer edge of the deflection channel corresponds to the outer circumference of the milling chamber.

9. The agitator ball mill according to claim 1, wherein the sieve is conically widened in the direction towards the outlet.

10. The agitator ball mill according to claim 1, wherein between the accelerators, disks for preventing axial flows are arranged on the shaft.

11. A method for preventing clogging of a sieve arranged upstream of a milling material outlet of an agitator ball mill, comprising the steps of:

providing an agitator ball mill as in claim 1;

flowing a mass of milling material and milling media from the milling material inlet to the milling material outlet;

deflecting the material and media at the sieve; and guiding the material and media along the outer surface of the sieve in a direction opposite to the flow direction thereby preventing clogging.

* * * * *